United States Patent [19]

Marsee

[11] 4,055,158

[45] Oct. 25, 1977

[54] EXHAUST RECIRCULATION

[75] Inventor: Frederick J. Marsee, Clawson, Mich.

[73] Assignee: Ethyl Corporation, Richmond, Va.

[21] Appl. No.: 668,589

[22] Filed: Mar. 19, 1976

Related U.S. Application Data

[63] Continuation-in-part of Ser. No. 458,508, April 8, 1974, abandoned, which is a continuation-in-part of Ser. No. 304,735, Nov. 8, 1972, abandoned, which is a continuation-in-part of Ser. No. 162,853, July 15, 1971, abandoned.

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,087,411 | 7/1937 | Lundquist | 123/119 A |
| 2,115,228 | 4/1938 | Lundquist | 123/119 A |
| 2,977,940 | 4/1961 | Theriault | 123/119 A |
| 3,412,722 | 3/1972 | Epifanio, Sr. | 123/119 A |
| 3,621,825 | 11/1971 | Ojaza | 123/119 A |
| 3,646,764 | 3/1972 | Nakajima et al. | 123/119 A |
| 3,677,239 | 7/1972 | Elkins | 123/119 A |

OTHER PUBLICATIONS

Society of Automotive Engineers, Report 700 146 of Jan. 12, 1970.

*Primary Examiner*—Wendell E. Burns

*Attorney, Agent, or Firm*—Donald L. Johnson; Robert A. Linn; Joseph D. Odenweller

[57] ABSTRACT

An improved internal combustion engine, exhaust gas recirculation (EGR) system is described which features the use of a liquid-cooled heat-exchange device to cool the recirculated exhaust before it is fed into the intake system of said engine. A preferred system uses a condensate trap situated downstream of said heat-exchange device. Use of this system effects further reduction in nitrogen oxides ($NO_x$) content of the exhaust.

7 Claims, 9 Drawing Figures

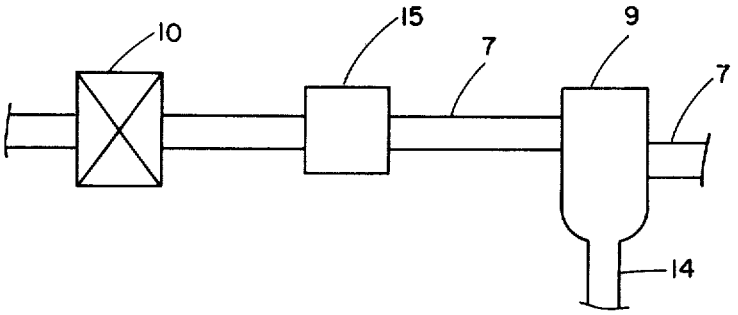
FIGURE 2
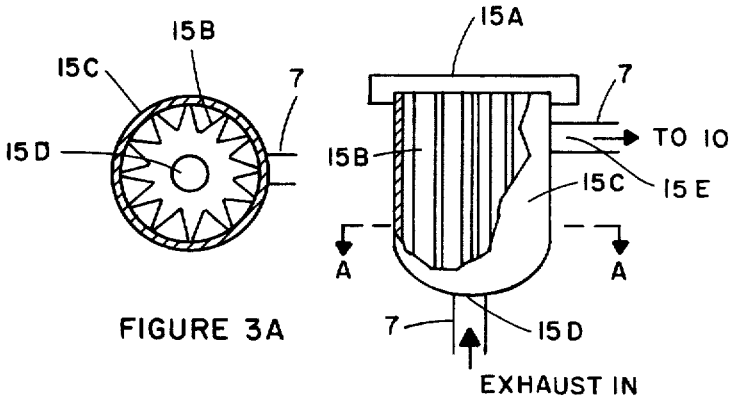
FIGURE 3A
FIGURE 3

EXHAUST RECIRCULATION

CROSS-REFERENCE TO RELATED APPLICATIONS

This application is a Continuation-in-Part of application Ser. No. 458,508, filed Apr. 8, 1974, now abandoned which in turn is a Continuation-in-Part of application Ser. No 304,735, filed Nov. 8, 1972, now abandoned, which in turn is a Continuation-in-Part of application Ser. No. 162,853, filed July 15, 1971, now abandoned.

BACKGROUND OF THE INVENTION

The nitrogen oxide content of exhaust from an internal combustion engine can be reduced by recirculating or recycling a portion of the exhaust into the intake system of the engine. This exhaust for recycle can be obtained from any portion of the exhaust system of the engine; and various means are available for controlling the amount of exhaust which is recirculated.

It has now been discovered that by cooling the recycle exhaust before it is introduced into the intake system, an additional reduction in nitrogen oxide content of the exhaust is unexpectedly achieved; and an additional benefit is obtained since the cooling device removes other material suspended in the exhaust. Preferably, the exhaust is cooled to a temperature below about 250° F. A useful temperature range is about 150° F to about 250° F.

SUMMARY OF THE INVENTION

The invention comprises an improved internal combustion engine exhaust gas recirculation system for decreasing $NO_x$ emissions. The improved system includes liquid-cooled heat-exchange means in the exhaust gas recycle passage which cools the recycle exhaust gas below about 250° F prior to metering it into the air/fuel induction system.

DESCRIPTION OF THE DRAWINGS

FIG. 2 is a schematic illustration of one portion of the improved exhaust recirculation system of FIG. 1 with particulate trap means added.

FIGS. 3 and 3A are illustrations in partial section of a type of particulate trap means.

DESCRIPTION OF THE PREFERRED EMBODIMENTS

The present invention is embodied in an exhaust recirculation system for an internal combustion engine which is provided with a heat-exchange device for cooling the exhaust which is to be recirculated. In a preferred embodiment, a condensate trap is provided downstream of said heat-exchange device. In a most preferred embodiment, the heat-exchange device utilizes engine coolant as the heat-exchange medium. A most preferred embodiment of this invention is illustrated in FIG. 1, which is considered in more detail below.

Figure 1:
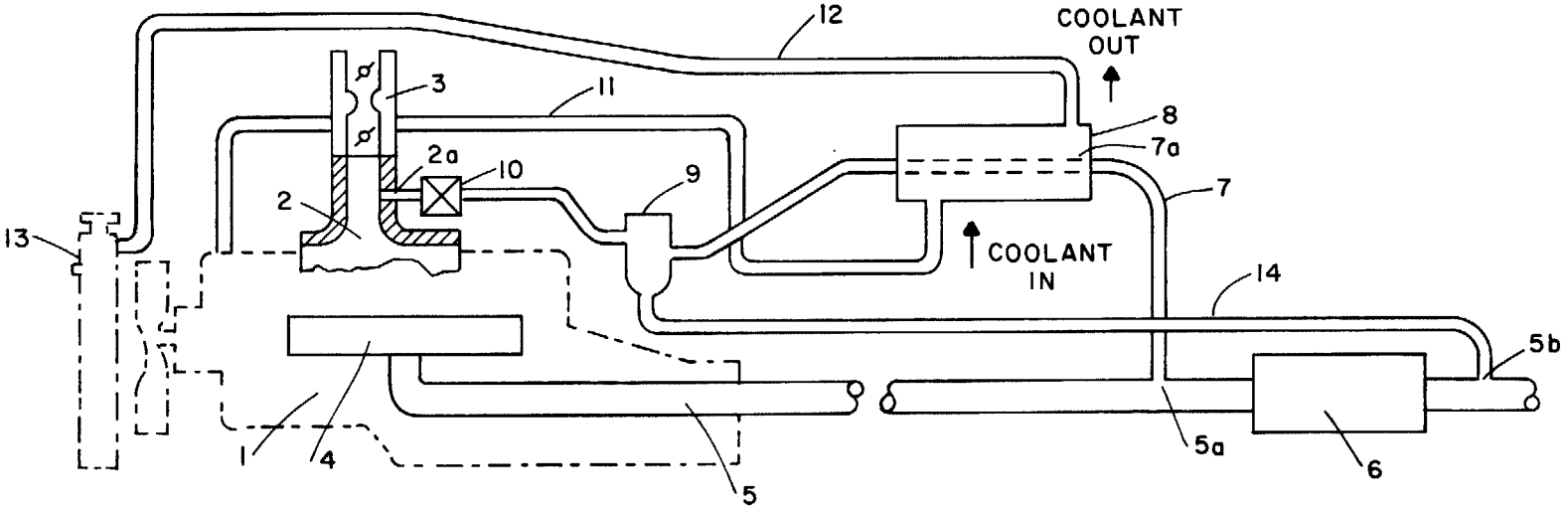
FIG. 1 is a schematic illustration of an improved exhaust recirculation system of the present invention. The drawing is not to scale.

In FIG. 1, an engine 1 (in phantom) is shown having an induction system comprising an intake manifold 2, a carburetor 3, and an exhaust system comprising an exhaust manifold 4, an exhaust pipe 5, and a muffler 6. Although not shown, the exhaust system may also include catalytic converters, afterburners, and the like, between the exhaust manifold 4 and the muffler 6. The exhaust for recirculation is obtained through an opening **5*a* in the exhaust pipe 5 upstream of said muffler 6, and is carried through conduit 7 into the intake manifold 2 through opening 2*a* below said carburetor 3. The recirculation exhaust conduit 7 is provided with a heat-exchange device 8, a condensate trap 9 downstream of said heat-exchange device 8 and a metering device 10, which controls the amount of recycle exhaust fed into the intake manifold. Any suitable metering device can be utilized; a preferred metering device is one wherein the metering control is responsive to engine vacuum and preferably carburetor venturi vacuum; such a preferred device is described in my copending application Ser. No. 304,734, filed Nov. 8, 1972, which is a Continuation-in-Part of application Ser. No. 228,053, filed Feb. 22, 1972, now abandoned, which in turn is a Continuation-in-Part of application Ser. No. 157,122, filed June 25, 1971, now abandoned. The disclosure in the aforesaid applications is incorporated herein by reference. The heat-exchange device 8 utilizes engine coolant as the heat-exchange medium. Engine coolant flows from the engine 1 through conduit 11 into the heat exchange device 8 and the coolant is returned via conduit 12 to the radiator 13** (in phantom). Although a separate liquid heat-exchange medium and circulating system could be provided, use of engine coolant and circulation system is convenient, simple, and economical.

The size or capacity of the heat-exchange device is preferably sufficient to permit cooling the exhaust gas to temperatures below about 250° F, for example, between about 150° F and about 250° F, and preferably between about 170° F to about 185° F.

In addition, the section **7*a* of conduit 7 which passes through the heat-exchange device 8 is shown to be a straight tube. It is advantageous to provide some baffling within this section 7*a*** in order to effect a turbulent, mixing action, thus improving the efficiency of the heat-exchange device. Various baffle arrangements to accomplish this are available. A baffle system which has maximum mixing efficiency and minimum back pressure effect is preferred. An especially useful baffle configuration is described in U.S. Pat. No. 3,286,992.

The condensate trap 9 can be of any conventional design. As FIG. 1 shows, it is preferred that this condensate trap 9 be physically located downstream and below said heat-exchange device 8. In this way, if any condensate forms in the **7*a* portion of the conduit within the heat-exchange device 8, then it can freely flow via conduit 7 down into the trap 9. The condensate which is collected in trap 9 is bled via conduit 14 into the exhaust pipe 5 through opening 5*b* downstream of said muffler 6** to be discharged into the atmosphere. This condensate is principally water. Although conventional direct drainage of the condensate can be utilized, the novel arrangement illustrated in FIG. 1 is preferred since it offers the advantage of being positive and continuous.

The schematic illustration of FIG. 1 shows the exhaust for recirculation to be obtained at a point 5*a* in the exhaust pipe 5 upstream of said muffler 6. It is preferred to obtain exhaust for recirculation at this point. However, the exhaust for recirculation can be obtained from any point in the exhaust system as desired. Thus, for example, exhaust for recirculation could be obtained from an exhaust cross-over or the exhaust manifold 4 or any other point along the exhaust pipe 5. By obtaining the exhaust for recirculation further down the exhaust system (e.g., as in FIG. 1) two advantages are realized — (1) the initial exhaust temperature is lower, and (2) there are fewer suspended materials in the exhaust. Since the exhaust is cooler to begin with, a lower capacity heat-exchange device can be utilized; and since fewer suspended materials are in the exhaust, there is less possibility of clogging small openings and valves in the system, such as those which might be found in the metering device (e.g., element 10 in FIG. 1).

Although FIG. 1 shows a condensate trap 9 in the system, this trap is not a required element. It provides the benefit of removing most of the condensate from the recycle exhaust stream; but it is essentially the cooling of the exhaust and not the lowered condensate content which effects the unexpected lowering of $NO_x$ emissions.

With regard to the suspended material in this recirculated exhaust, the heat-exchange device used in the present system has also been found to trap more of the suspended materials. This further reduces deposit formation in the portion of the exhaust recycle system downstream from the heat-exchange device.

Although the heat-exchange system illustrated in FIG. 1 does effect removal of a portion of suspended particulate matter from the exhaust which is recirculated, it is advantageous to remove substantially all of this particulate matter to minimize engine wear problems. This is conveniently accomplished by placing particulate trap means in the present system. This particulate trap means may be of any suitable design or configuration and may be positioned anywhere in the system at or downstream from the opening 5*a* in FIG. 1, the point at which exhaust gas is obtained from the exhaust system. However, a most preferred placement of particulate trap means is that illustrated in FIG. 2. In FIG. 2, particulate trap means 15 is positioned near the metering device 10 and downstream from the condensate trap 9. Placing the particulate trap means 15 in this location offers a number of important advantages. One advantage is that particulate trap means 15 will be more efficient and effective because it takes advantage of the aforesaid particulate removal effected by the downstream portion of the exhaust recirculation cooling system. Another advantage is that the exhaust flowing to particulate trap means 15 is relatively cool and also substantially free from condensate (which is principally water) — consequently, said particulate trap means 15 can be a simple filter means having a flter element made of common, inexpensive, readily available filter construction material, e.g., glass wool, fiber glass, paper, other cellulosic materials, and the like. Finally, by positioning said particulate trap means 15 as shown in FIG. 2, that is, near the metering device 10, the particulate trap means is readily accessible for maintenance.

FIG. 3 illustrates a type of simple filter means which is useful as a particulate trap means. This filter means comprises a body 15*c* which has a removable cover 15*a*. This body 15*c* contains a filter element 15*b* which is shown as a fluted, cellulosic material. This filter element is replaceable. The exhaust enters through conduit 7 into the body 15*c* through filter element 15*b*, then out opening 15*e* to the metering device 10 (not shown). FIG. 3A is a section through the FIG. 3 filter means showing the approximate disposition of the elements within the FIG. 3 filter means. The filter means illustrated in FIG. 3 is readily serviced by removing cap 15*a* and replacing the filter element 15*b*. The filter element 15*b* can be made of any suitable material of construction. Many materials are known or are readily suggested to those skilled in the art and need not be described in any detail here.

If the cooling system does not have a condensate trap 9 as illustrated in FIGS. 1 and 2, filter means can still be used as particulate trap means 15 and is preferably positioned near the metering device 10.

The addition of particulate trap means, and especially a simple filter means, in the present exhaust recirculation system has been shown to be an economical and effective way to reduce wear in certain engine areas, e.g., the timing gear section.

Figure 4:
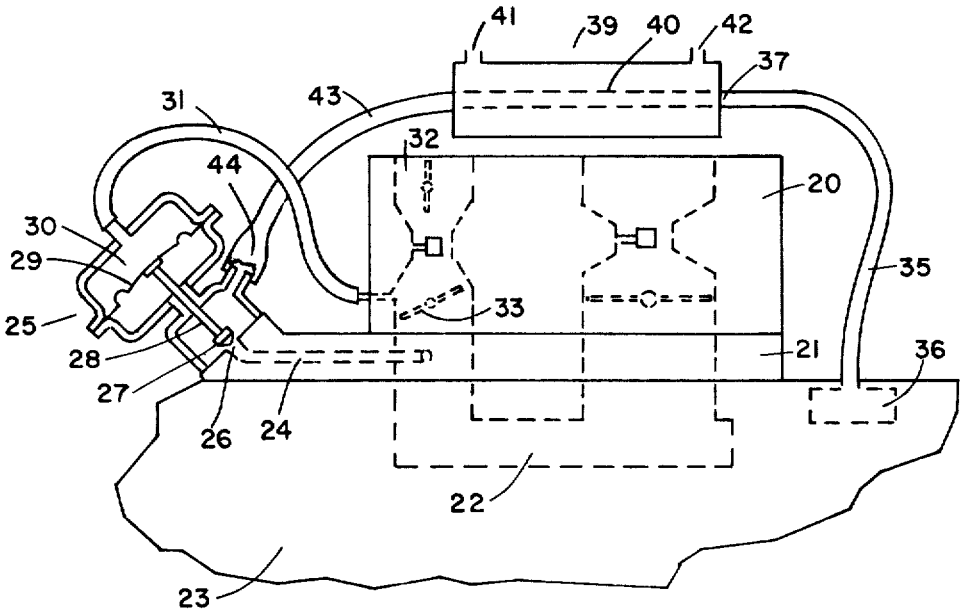
FIG. 4 is a view of the fuel induction portion of an engine fitted with a liquid-cooled exhaust gas recycle system.

FIG. 4 shows another embodiment of my invention in which the entire liquid-cooled EGR system is mounted on an internal combustion engine. Four-barrel carburetor 20 is mounted on spacer 21 which is connected to the induction manifold 22 of engine 23, only a portion of which is shown. Spacer 21 has a passage 24 which connects to both primary barrels (only one of which 32 is shown) of carburetor 20. Exhaust gas recycle valve 25 is mounted on spacer 21 over EGR port 26. Poppet valve 27 is connected through rod 28 to diaphragm 29. Vacuum housing 30 is connected by vacuum line 31 to a primary carburetor barrel 32 which is above throttle valve 33.

Exhaust gas recycle conduit 35 connects exhaust gas cross-over 36 to the inlet 37 of liquid-cooled heat exchanger 39, which is not drawn to scale. A single heat exchange tube 40 is shown, although, as will be described later, a multiple tube exchanger may be used. Liquid coolant from the engine coolant system enters the exchanger jacket at 41 and exits at 42 to return to the coolant system. After traversing the heat exchanger the coolant passes through conduit 43 to the entry port 44 of EGR valve 25.

In operation, the engine is started and as throttle valve 33 opens, a vacuum signal is transmitted by line 31 to vacuum housing 30 wherein it acts upon diaphragm 29 withdrawing poppet valve 27 and allowing cooled recycle exhaust gas to enter each of the primary barrels. Exhaust gas is withdrawn from exhaust cross-over 36 and passes through liquid-cooled heat exchanger 39 and is cooled. It is then conducted through conduit 43 to entry port 44 of EGR valve 25.

Figure 5:
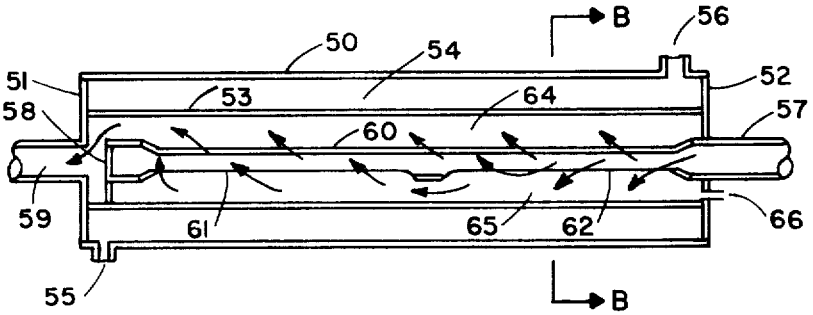
FIG. 5 is a cross-section of one type of liquid-cooled heat exchanger.
Figure 6:
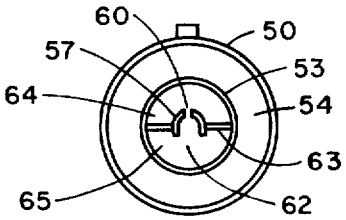
FIG. 6 is a cross-section of the liquid-cooled heat exchanger of FIG. 5.

FIG. 5 shows a preferred liquid-cooled heat exchanger. It comprises outer cylindrical jacket 50 and end closures 51 and 52. Intermediate cylindrical jacket 53 forms annular space 54. Liquid coolant enters space 54 through inlet 55 and exits through outlet 56. Outlet 59 is centrally located in end closure 51. Tube 57 extends through end closure 52 and inside jacket 53 and is closed at end 58. A narrow slot 60 extends along the length of tube 57 inside jacket 53. Two wide slots 61 and 62 extend along the bottom of tube 57. Partition 63 separates the space within jacket 53 into upper chamber 64 and lower chamber 65. The only substantial communication between chamber 64 and chamber 65 is through slots 60, 61 and 62. Partition 63 has small drain openings (not shown) where it abuts end closure 52 to permit any water that condenses in chamber 64 to drain into chamber 65. Drain port 66 connects the bottom of chamber 65 to a drain line.

In operation, inlet 55 and outlet 56 are operatively connected to the engine coolant system such that engine coolant circulates through annular space 54. Exhaust gas is conducted from any location in the engine exhaust system in through tube 57. Much of the exhaust gas enters chamber 65 through slots 62 and 61 and is cooled. Any water that forms is drained through drain port 66 back to the exhaust system at a location downstream from where the recycle exhaust gas is withdrawn. The exhaust passes up through slot 69 into chamber 64 and then through outlet 59 and is finally conducted through the EGR recycle valve to the engine air/fuel induction system.

Figure 7:
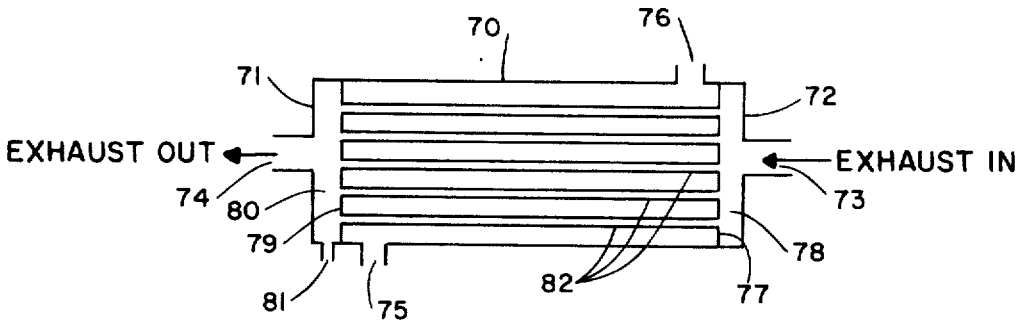
FIG. 7 is a schematic cross-section of a multiple tube liquid-cooled heat exchanger.

Various types of liquid-cooled heat exchangers may be employed. FIG. 7 illustrates a useful heat exchanger which comprises a plurality of tubular conduits forming part of the exhaust recycle passage. The outer surface of the tubes is in heat exchange contact with liquid coolant. The exchanger is constructed of housing 70 and end closures 71 and 72 having exhaust inlet 73 and outlet 74. Housing 70 has a coolant inlet 75 and outlet 76. Partition 77 forms entry plenum 78 and partition 79 forms exit plenum 80. There is a drain opening 81 in the bottom of housing 70 between end closure 71 and partition 79. A plurality of tubes 82 connect through partitions 77 and 79 and form a passage from plenum 78 to plenum 80.

In operation, inlet 75 and outlet 76 are operatively connected to the engine coolant system such that cooled liquid coolant circulates through the space between partitions 77 and 79. Exhaust inlet 73 is operatively connected to any location in the engine exhaust system including the exhaust cross-over, exhaust manifold and exhaust pipe. Hot engine exhaust enters inlet 73 and passes through tubes 82 wherein it is cooled by contact with the inside surface of tubes 82. The cooled exhaust enters outlet plenum 80. Any moisture that has condensed drops to the bottom of plenum 80 and is drained through opening 81 to a conduit (not shown) back to the exhaust system at a location downstream from where the recycle exhaust gas is withdrawn. The cooled dry exhaust gas passes through outlet 74 and through a conduit (not shown) to the EGR valve which meters the cooled exhaust into the air/fuel induction system.

Figure 8:
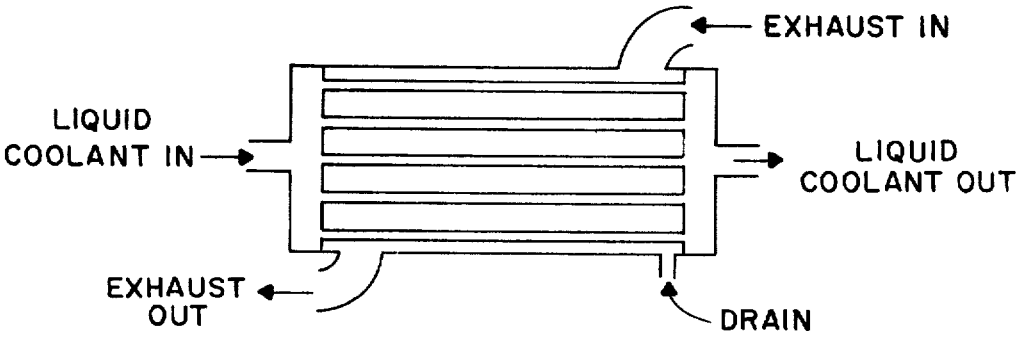
FIG. 8 is a schematic cross-section of another type multiple tube liquid-cooled heat exchanger.

A similar heat exchanger is shown in FIG. 8 which comprises a plurality of tubular conduits through which liquid coolant circulates. The exhaust gas contacts the outer surface of the conduits and is thereby cooled.

In order to demonstrate the effectiveness of the present recirculation system on $NO_x$ emissions, an 8-cylinder, V-8 spark ignition internal combustion engine having a carburetor/intake manifold induction system, insulated exhaust manifold and exhaust ports as described in U.S. Pat. No. 3,577,727, was provided with an exhaust recirculation system as illustrated in FIG. 1, but without a heat-exchange device and the condensate trap. The carburetor used was of the type disclosed in U.S. Pat. No. 3,768,787; the recycle metering device used was the preferred device disclosed above. The $NO_x$ emissions for this engine were determined according to the 1970 Federal Test Procedure for Emissions Determination using a leaded gasoline fuel. The temperature of the exhaust as it entered the intake manifold was between 400° F and 800° F.

The exhaust recirculation system of the engine was then modified by installing a liquid-cooled heat-exchange device as illustrated in FIG. 1, again without the condensate trap. The temperature of the exhaust as it entered the intake manifold was about 180° F. The $NO_x$ emissions were then determined for the engine using the same leaded fuel and the Federal Test Procedure. The $NO_x$ emissions for this engine (which was equipped with a liquid-cooled heat-exchange device) were 10% lower than tne $NO_x$ emissions from the engine when no heat-exchange device was provided. In addition, on dismantiling the heat-exchange device it was found that particulate matter suspended in the exhaust had also been trapped therein. Thus, by providing a heat-exchange device to cool the exhaust which is recirculated into the intake system of an engine (1) there is a substantial lowering of $NO_x$ emissions from the engine, and (2) there is an additional removal of suspended particulates from the exhaust. Thus, use of the present exhaust recirculation system contributes to reducing undesirable contaminants in the atmosphere.

Besides the system embodiment, the present invention also encompasses an improved method of reducing $NO_x$ emissions from an internal combustion engine which is equipped with an exhaust recirculation system by cooling the exhaust to be recirculated using a liquid-cooled heat exchanger to a temperature of between 150° F and 250° F.

I claim:

1. In a spark ignited internal combustion engine having a carburetor type fuel/air induction system and an exhaust system, said engine having an exhaust recycle passage through which a portion of the exhaust gas is recycled from said exhaust system to said fuel/air induction system thereby lowering the nitrogen oxides content of the exhaust gas emitted by said engine, the improvement comprising a liquid-cooled heat exchanger in said exhaust recycle passage whereby exhaust gas flowing through said recycle passage passes through said heat exchanger and comes into heat exchange contact with the cooled surfaces within said liquid-cooled heat exchanger and is cooled below about 250° F, said heat exchanger comprising a heat exchanger housing through which said recycle exhaust gas passes and comes into heat exchange contact with a liquid-cooled surface, said housing having a drain opening at a low point, said drain opening being connected by a drain conduit to said exhaust system at a location downstream from where said exhaust recycle passage connects to said exhaust system, said recycle passage being connected to deliver cooled recycle exhaust to said fuel/air induction system downstream from the throttle plate of said carburetor whereby the nitrogen oxide content of said exhaust gas is lowered to an extent substantially greater than that obtained without said cooling.

2. The improvement of claim 1 wherein said liquid is circulating liquid engine coolant.

3. The improvement of claim 2 wherein said heat exchanger comprises a plurality of tubular conduits in parallel through which said liquid engine coolant circulates, the outer surface of said tubular conduits being in heat exchange contact with said exhaust gas flowing through said recycle passage.

4. The improvement of claim 2 wherein said heat exchanger comprises a plurality of tubular conduits in parallel forming part of said recycle passage, the outer surface of said tubular conduits being in heat exchange contact with said liquid engine coolant.

5. The improvement of claim 1 which additionally includes a filter in said exhaust recycle passage downstream from said heat exchanger.

6. In a spark ignited internal combustion engine having a carburetor type fuel/air induction system and an exhaust system, said engine having an exhaust recycle passage through which a portion of the exhaust gas is recycled from said exhaust system to said fuel/air induction system thereby lowering the nitrogen oxides content of the exhaust gas emitted by said engine, the improvement comprising a liquid-cooled heat exchanger in said exhaust recycle passage whereby exhaust gas flowing through said recycle passage passes through said heat exchanger and comes into heat exchange contact with the cooled surfaces within said liquid-cooled heat exchanger and is cooled below about 250° F, said exhaust recycle passage including a condensate trap, said trap comprising a housing having a recycle exhaust gas inlet and outlet, said trap being operatively connected in said exhaust recycle passage between said heat exchanger and said induction system, said housing having a drain opening at a low point, said drain opening being connected by a drain conduit to said exhaust system at a location downstream from where said exhaust recycle passage connects to said exhaust system, said recycle passage being connected to deliver cooled recycle exhaust to said fuel/air induction system downstream from the throttle plate of said carburetor whereby the nitrogen oxide content of said exhaust gas is lowered to an extent substantially greater than that obtained without said cooling.

7. The improvement of claim 6 which additionally includes a filter in said exhaust recycle passage downstream from said condensate trap.

* * * * *